US007766323B2

(12) United States Patent
Pillard et al.

(10) Patent No.: US 7,766,323 B2
(45) Date of Patent: Aug. 3, 2010

(54) DEVICE FOR STACKING MAIL ITEMS

(75) Inventors: Romain Pillard, Paris (FR); Cyril Janot, Levallois-Perret (FR)

(73) Assignee: NEOPOST Technologies, Bagneux (GR)

( * ) Notice: Subject to any disclaimer, the term of this patent is extended or adjusted under 35 U.S.C. 154(b) by 0 days.

(21) Appl. No.: 11/939,674

(22) Filed: Nov. 14, 2007

(65) Prior Publication Data

US 2008/0138188 A1 Jun. 12, 2008

(30) Foreign Application Priority Data

Nov. 16, 2006 (FR) ..... 0654935

(51) Int. Cl.
*B65H 5/00* (2006.01)
*B65H 31/04* (2006.01)
*B65H 43/04* (2006.01)
*B65H 31/00* (2006.01)

(52) U.S. Cl. ..... 271/198; 271/213; 271/2; 271/209

(58) Field of Classification Search ..... 271/198, 271/213, 161, 209, 207, 2
See application file for complete search history.

(56) References Cited

U.S. PATENT DOCUMENTS 4,861,014 A * 8/1989 Martin ..... 271/198
5,022,641 A * 6/1991 Okada ..... 271/3.08
5,060,923 A * 10/1991 Takimoto et al. ..... 271/7
5,364,090 A * 11/1994 Hollis et al. ..... 271/216
5,464,317 A 11/1995 Foster et al.
5,508,818 A * 4/1996 Hamma ..... 358/403
6,095,517 A * 8/2000 Dinatale ..... 271/212
6,250,629 B1 * 6/2001 Brown et al. ..... 271/220
7,178,801 B2 * 2/2007 Kokubo et al. ..... 271/213
2003/0189283 A1 * 10/2003 Sloan et al. ..... 271/198
2005/0056991 A1 * 3/2005 Sullivan ..... 271/265.01
2005/0206075 A1 * 9/2005 Yago ..... 271/272

FOREIGN PATENT DOCUMENTS

DE 4125451 * 2/1993

* cited by examiner

*Primary Examiner*—Patrick Mackey
*Assistant Examiner*—Patrick Cicchino
(74) *Attorney, Agent, or Firm*—Sughrue Mion, PLLC

(57) ABSTRACT

Together with a device for receiving mail items that has a conveyor belt designed to receive and to convey the mail items from a franking station of a mail handling machine, a device is provided for stacking mail items that has a plurality of rollers disposed in staggered manner on a plurality of axles whose ends are fixed to respective ones of two support walls between which the axles extend, which support walls are mutually parallel and are spaced apart by at least the width of said conveyor belt.

8 Claims, 1 Drawing Sheet

DEVICE FOR STACKING MAIL ITEMS

FIELD OF THE INVENTION

The present invention relates to the field of mail handling, and it relates more particularly to a device for stacking mail items for a device for receiving mail items in a mail handling machine.

PRIOR ART

A mail handling machine is conventionally made up of three main elements: a mail item feeder; a "postage meter" or franking station for franking the mail items, which station is disposed at the outlet of the feeder (which can optionally incorporate a weigh device); and, disposed at the outlet of the franking station, a device (stacker) for receiving the mail items once they have been franked by the franking station. Currently such a machine can frank mail items of all weights and formats, and the device for receiving the mail items must thus be capable of receiving and storing all of the mail items correctly. That is why such a device is generally constituted merely by a tray forming a receptacle in which the mail items of all formats are stored flat and in mixed manner in a small-capacity stack (about 100 envelopes of medium thickness) as they are franked. Unfortunately, for high throughputs, e.g. of about 15,000 envelopes per hour (i.e. 4 envelopes per second), this configuration makes it necessary to stop the machine frequently, and thus to interrupt mail item franking frequently, for the purpose of removing the franked mail items from the receptacle and of putting them into mail bins, each of which has a storage capacity of about 500 envelopes.

U.S. Pat. No. 5,464,317 discloses an automatic stacker that implements a conveyor of the belt type disposed lengthwise or perpendicularly at the outlet of the franking station, that conveyor making it possible to store the franked mail items in a vertical position by accumulation by means of two worm screws disposed horizontally. That device makes it possible to store nearly 500 envelopes, in theory, and it is relatively well suited to thin and flexible envelopes. However, it tends to jam with thick envelopes which cannot fit between the threads of the worm screws, and which curve up against the end plate. As a result, the envelopes accumulate in a substantially flat stack, reducing the working length of the stacker by nearly 50%.

OBJECT AND DEFINITION OF THE INVENTION

An object of the present invention is to provide a device for receiving mail items that mitigates those drawbacks and receives the envelopes vertically regardless of their thicknesses. Another object of the invention is to provide a device that is as simple, compact, and ergonomic as possible while also maximizing the working length of the device.

These objects are achieved by a device for stacking mail items for a device for receiving mail items, the device for receiving mail items having a conveyor belt designed to receive and to convey the mail items from a franking station of a mail handling machine, said device for stacking mail items having a plurality of rollers disposed in staggered manner on a plurality of axles whose ends are fixed to respective ones of two support walls between which the axles extend, which support walls are mutually parallel and are spaced apart by at least the width of said conveyor belt.

Thus, with this configuration, it becomes possible to store a quantity of envelopes that actually corresponds to the working length of the conveyor belt.

Preferably, said axles are fixed to the two support walls in a manner such that the peripheral surface of each of the rollers is disposed on a support straight line that is inclined relative to the surface of said conveyor belt. The inclination of said support straight line may be variable from a minimum inclination to a maximum inclination depending on the type of mail item handled. Said inclination may lie in the range 45° to 70°.

Preferably, the device has three series of rollers.

Advantageously, the device also has a horizontal plate that is fixed between the two support walls and that is comb-shaped with notches, the number of which notches corresponds to the number of rollers present in the first one of said series of rollers, and an end-wall plate that is also comb-shaped with notches, the number of which notches corresponds to the number of rollers present in the last one of said series of rollers.

Preferably, said end-wall plate has a perpendicular folded-over leaf provided with a slot for slidably receiving clamping means that are secured, for example, to one of said support walls, and that, when tightened, define an inclination position for said end-wall plate.

BRIEF DESCRIPTION OF THE DRAWINGS

The characteristics and advantages of the present invention appear more clearly from the following description given by way of non-limiting indication, with reference to the accompanying drawing, in which.

DETAILED DESCRIPTION OF A PREFERRED EMBODIMENT

Figure 3:
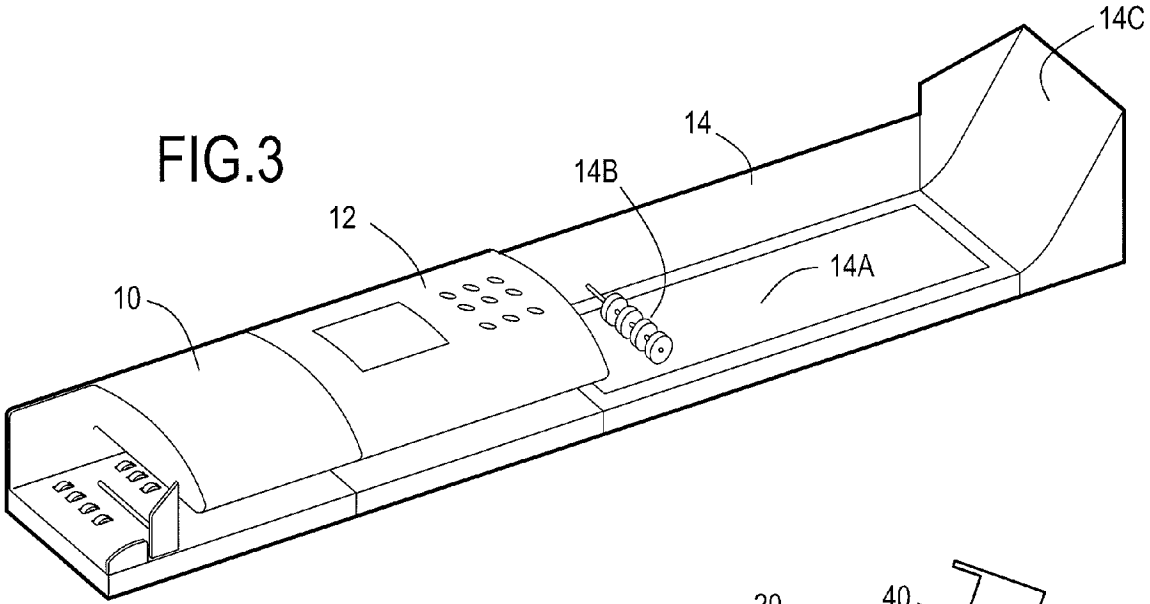
FIG. 3 is a perspective view of a mail handling machine including a prior art mail item receiver device.

A prior art mail handling machine is shown in FIG. 3. That machine essentially comprises, from upstream to downstream relative to the direction in which the mail items advance: a mail item feeder 10; a franking station 12; and, disposed at the outlet of said franking station which optionally incorporates a weigh module, a mail item receiver device or stacker 14 for receiving the franked mail items. The mail item receiver device is made up in known manner of a motor-driven conveyor belt 14A for receiving and conveying the mail items ejected one-by-one by the franking station disposed upstream, of presser elements (backing rollers 14B) for braking the envelopes ejected in this way, and of an end plate 14C against which the mail items accumulate on edge, i.e. in a vertical position, thereby facilitating subsequent handling of them by automated mail handling machines.

The assembly made up of all of those elements is stood on a work surface (not shown) so as to be easily available to an operator in charge of the franking operations and whose working position is, in general, in front of said work surface. Such a machine can frank mail items of different formats, ranging from US format No. 5 (76.2 millimeters (mm)×127 mm) to European format B4 (250 mm×353 mm) and including standard European format C6/5 (114 mm×229 mm), and up to a determined thickness, e.g. 16 mm, corresponding to the height of the slot via which the mail items are inserted into the franking station 12.

In accordance with the invention, the end plate is replaced with a stacker device 20 having a plurality of series of superposed rollers mounted to be free to rotate about their respective axles. These series of rollers are preferably interlaced, i.e. the various rollers are disposed in staggered manner. In order to avoid any contact between the rollers of two adjacent series having the same parity (first and third, second and fourth, etc.) and that are thus in line due to the staggered configuration, the radius of each of the rollers is naturally smaller than the distance between the axes of two adjacent axles.

In the example shown, the device has three series of rollers 22, 24, 26, each of which has four rollers and in which the ends 28A, 28B; 30A, 30B; 32A, 32B of the axles 28, 30, 32 of the rollers are fixed to respective ones of two support walls 34 36 between which the axles extend, which support walls are mutually parallel and are spaced apart by at least the width of the conveyor belt 14A. The axles are fixed to the two support walls in a manner such that the peripheral surface of each of the rollers forming the three series of rollers is disposed on the same straight line that is inclined relative to the surface of the conveyor belt, and can thus form a rectilinear support for the first mail item that comes to rest on it and for the subsequent mail items. In addition, the inclination of this support straight line is not a single inclination that is set once and for all, but rather it is variable. It can be modified from a maximum inclination of 70° to a minimum inclination of 45° depending on the type of mail item handled.

Figure 1:
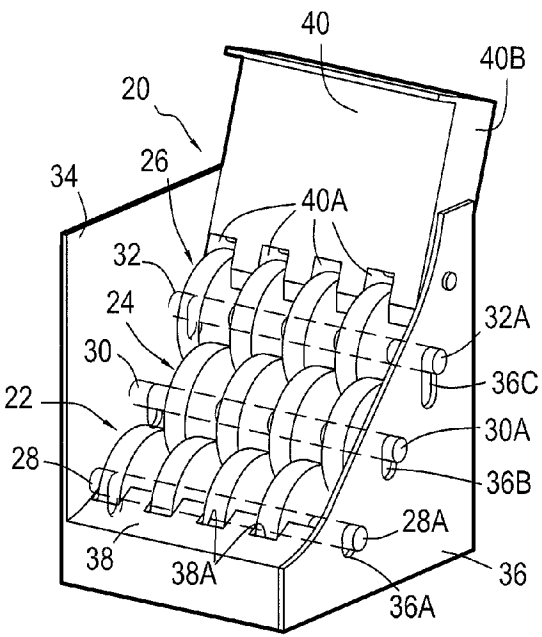
FIG. 1 is a perspective view of a mail item receiver device of the invention.
Figure 2:
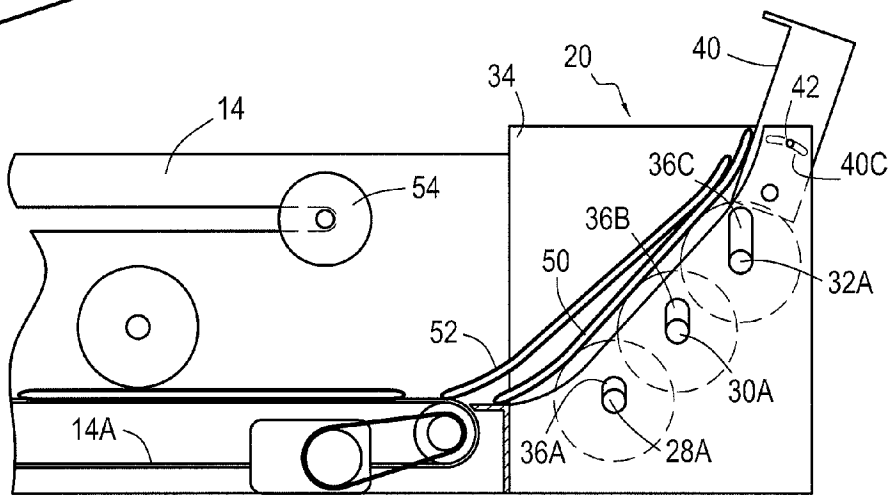
FIG. 2 is a section view showing how the mail items are stacked at the mail item receiver device of FIG. 1.

More precisely, each of the axles 28, 30, 32 of the series of rollers can slide in two opposite vertical slots 34A, 34B, 34C; 36A, 36B, 36C provided respectively in each support wall 34, 36, the positioning of the axles along the slots defining the inclination of the support line. Thus, in the high position, as shown FIG. 1, the inclination is substantially 70° while in the low position, as shown in FIG. 2, the inclination is substantially 45°.

The device joins the conveyor belt via a substantially horizontal plate 38 that is fastened between the two support walls 34 and 36 and that is comb-shaped with notches 38A, the number of which notches corresponds to the number of rollers present in the first series of rollers 22. For large envelopes, the device is also provided with an end-wall plate 40 whose inclination is adjustable and that is also comb-shaped with notches 40A, the number of which notches corresponds to the number of rollers present in the last series of rollers 26. More particularly, this end-wall plate has a perpendicular folded-over leaf 40B that is provided with a slot 40C for slidably receiving clamping means such as a nut-and-bolt fastener 42 secured, for example, to one of the support walls 34, and, when tightened, defining the inclination position taken up by the end-wall plate.

Operation of the device of the invention is described below with reference to FIG. 2. The mail items are ejected as flat and one-by-one from the outlet of the franking station onto the start of the conveyor belt which then drives them towards its end. On the belt, due to the high franking throughput, the mail items overlap in part, thereby forming a shingle pattern. At the end of the conveyor belt, the first mail item 50 is driven onto the rollers of the stacker device. The fact that the rollers are mounted to be free to rotate makes it possible to limit the coefficient of friction and to ensure that the envelopes are free to rise as they arrive. The second mail item 52 does the same, and is stacked on the first mail item and so on for the following mail items.

It should be noted that holding the stack in the vertical position can be facilitated by the presence of moving presser means, e.g. rollers 54 that are mounted to be free to rotate on their axle and that retract towards the front of the conveyor belt as the stack forms.

Similarly, it should be noted that, although the conveyor belt can be disposed as in FIG. 3, it can also be disposed perpendicularly at the front of the franking station or at the back thereof, the stacker device of the invention being adapted to all such configurations.

What is claimed is:

1. A device for stacking mail items for a device for receiving mail items, the device for receiving mail items having a conveyor belt designed to receive and to convey the mail items from a franking station of a mail handling machine, said device for stacking mail items having a plurality of rollers disposed in an interlaced manner on a plurality of axles whose ends are fixed to respective ones of two support walls between which the axles extend, which support walls are mutually parallel and are spaced apart by at least the width of said conveyor belt, wherein the rollers are inclined relative to the device for receiving mail items.

2. A device according to claim 1, wherein said axles are fixed to the two support walls in a manner such that the peripheral surface of each of the rollers is disposed on a support straight line that is inclined relative to the surface of said conveyor belt.

3. A device according to claim 2, wherein the inclination of said support straight line is variable from a minimum inclination to a maximum inclination depending on the type of mail item handled.

4. A device according to claim 3, wherein said inclination lies in the range 45° to 70°.

5. A device according to claim 1, comprising three series of rollers.

6. A device according to claim 1, further comprising a horizontal plate that is fixed between the two support walls and that is comb-shaped with notches, the number of which notches corresponds to the number of rollers present in the first one of said series of rollers.

7. A device according to claim 1, further comprising an end-wall plate that is also comb-shaped with notches, the number of which notches corresponds to the number of rollers present in the last one of said series of rollers.

8. A device according to claim 7, wherein said end-wall plate has a perpendicular folded-over leaf provided with a slot for slidably receiving clamping means that are secured to one of said support walls, and that, when tightened, define an inclination position for said end-wall plate.

* * * * *